US009993685B2

(12) United States Patent
Stevens

(10) Patent No.: US 9,993,685 B2
(45) Date of Patent: Jun. 12, 2018

(54) PUSH-UP DEVICE AND METHOD OF USE

(71) Applicant: Albert Clay Stevens, St. Augustine, FL (US)

(72) Inventor: Albert Clay Stevens, St. Augustine, FL (US)

( * ) Notice: Subject to any disclaimer, the term of this patent is extended or adjusted under 35 U.S.C. 154(b) by 0 days. days.

(21) Appl. No.: 15/383,525

(22) Filed: Dec. 19, 2016

(65) Prior Publication Data

US 2017/0173382 A1 Jun. 22, 2017

Related U.S. Application Data

(60) Provisional application No. 62/413,651, filed on Oct. 27, 2016, provisional application No. 62/269,939, filed on Dec. 19, 2015.

(51) Int. Cl.

| | |
|---|---|
| ***A63B 71/00*** | (2006.01) |
| ***A63B 26/00*** | (2006.01) |
| ***A63B 22/20*** | (2006.01) |
| ***A63B 21/00*** | (2006.01) |
| ***A63B 23/12*** | (2006.01) |
| ***A63B 23/02*** | (2006.01) |
| ***A63B 21/068*** | (2006.01) |

(52) U.S. Cl.

CPC ..... *A63B 22/20* (2013.01); *A63B 21/0004* (2013.01); *A63B 21/068* (2013.01); *A63B 21/4035* (2015.10); *A63B 21/4047* (2015.10); *A63B 23/0211* (2013.01); *A63B 23/1236* (2013.01); *A63B 26/003* (2013.01)

(58) Field of Classification Search

CPC . A63B 22/20; A63B 23/0205; A63B 23/1236; A63B 21/4035; A63B 21/4043

See application file for complete search history.

(56) References Cited

U.S. PATENT DOCUMENTS 3,306,626 A * 2/1967 Kawada ..... A63B 22/18 280/205
5,242,355 A 9/1993 Costa
7,621,858 B2 11/2009 Sheron
(Continued)

OTHER PUBLICATIONS

Website: http://www.theaveragebody.com/average_hand_size.php Archived: Jan. 28, 2012 Retrieved: May 23, 2017.*

*Primary Examiner* — Loan H Thanh
*Assistant Examiner* — Megan Anderson
(74) *Attorney, Agent, or Firm* — Johnson | Dalal; Mark C. Johnson

(57) ABSTRACT

A push-up device and method of use has been disclosed that employs the use of a spherical member that makes contact with the ground surface and supports the weight of a user when the user grasps the handle members of the push-up device and/or rests thereon. The user may balance his or her body on the push-up device while exercising. The push-up device is operable to permit the push-up device to move or translate in various directions or angles when the user is resting thereon by rotating the spherical member omni-directionally. As such, not only may a user stimulate chest and/or other upper-body muscles, but the user may also stimulate abdominals or other lower-body muscles, permitting the user to stimulate a more variety of his or her muscles through balancing himself or herself on the push-up device through the curved surface of the spherical member.

13 Claims, 13 Drawing Sheets

(56) References Cited

U.S. PATENT DOCUMENTS

| | | | | |
|---|---|---|---|---|
| 8,353,808 | B1 | 1/2013 | Barney | |
| 8,550,965 | B2 * | 10/2013 | Candela | A63B 23/0211 482/132 |
| 9,327,155 | B2 * | 5/2016 | Doyle | A63B 21/00 |
| 9,539,465 | B2 * | 1/2017 | Agostini | A63B 22/18 |
| 2008/0305935 | A1 | 12/2008 | Sanghavi | |
| 2011/0160024 | A1 | 6/2011 | Candela | |
| 2013/0184131 | A1 | 7/2013 | Doyle | |

* cited by examiner

PUSH-UP DEVICE AND METHOD OF USE

CROSS-REFERENCE TO RELATED APPLICATION

This application claims priority to U.S. Provisional Patent Application Nos. 62/413,651 filed Oct. 27, 2016, and 62/269,939 filed Dec. 19, 2015, the entirety of which are incorporated by reference.

FIELD OF THE INVENTION

The present invention relates generally to exercise devices, and, more particularly, relates to a push-up and/or abdominal exercise device.

BACKGROUND OF THE INVENTION

Exercise devices, including devices utilized for push-ups are well-known. However, those known exercise devices do not provide users the ability to support and/or balance themselves on those devices while in a push-up configuration and in an efficient and safe manner that is conducive to providing an effective workout.

For example, some known devices and methods utilize a stationary bar that is placed on a ground surface, wherein the bar is raised above the ground surface and enables users to support them on the ground surface. These devices and methods, however, are limited in the muscle groups that they target and do not provide much more muscular strengthening or conditioning than a typical and conventional push-up. These devices and methods also utilize a cumbersome and difficult to store and transport bar structure that many users unappealing and undesirable.

Other known devices and/or methods utilize two support structures having handles, wherein the support structures are operable to move on a ground surface. Each of the support structures are respectively held by the user during the push-up process or other exercise. While these devices do target various muscular groups through dynamic muscular stabilization, it is often done in an unsafe manner, as the user's arm(s) often stray too far along a translation path, putting significant strain and force on the joints of a user's upper body. As such, these devices are often unable to be used, or impracticable for use, by the elderly, users with minimal training, and/or users with medical limitations affecting the user's upper body.

Therefore, a need exists to overcome the problems with the prior art as discussed above.

SUMMARY OF THE INVENTION

The invention provides a push-up device and method of use that overcomes the herein aforementioned disadvantages of the heretofore-known devices and methods of this general type.

As With the foregoing and other objects in view, there is provided, in accordance with the invention, a push-up or abdominal device device having a base assembly having an upper surface and a ball housing with a concave inner surface spanning in a direction away from the upper surface of the base assembly to a lower end, wherein the concave inner surface of the ball housing defining a ball-housing cavity. The device also includes two elongated handle members coupled to the ball housing of the base assembly, wherein each of the two elongated handle members extend outwardly from respective sides of the ball housing in opposing directions to a terminal free distal end. The device also includes a substantially rigid spherical member disposed partially within, and outside of, the ball-housing cavity and having a bottom ground-contact surface opposing the upper surface of the base assembly, wherein the substantially rigid spherical member is operably configured to rotate within the ball housing.

In accordance with another feature, an embodiment of the present invention includes a ground-contact plane defined by the bottom ground-contact surface of the substantially rigid spherical member, wherein the ground-contact plane is parallel and non-co-planar with the orientation of the two elongated handle members. Further, the two elongated handle members may be disposed in a co-linear configuration with one another.

In accordance with yet another feature, an embodiment of the present invention also includes the two elongated handle members each having a proximal end and a handle member length separating the proximal end and the terminal free distal end and a user-gripping section disposed along the handle member length, wherein the user-gripping section spanning at least approximately two inches in length and of a diameter at most approximately six inches.

In accordance with yet another feature, an embodiment of the present invention also includes the upper surface of the base assembly also having an upper exterior surface area substantially all of a resilient and a flexible material.

In accordance with an additional characteristic, an embodiment of the present invention also includes the base assembly having a cushion coupled to an upper end of the ball housing, wherein the cushion defines the upper exterior surface.

In accordance with a further feature of the present invention, the substantially rigid spherical member is either a metallic or polymeric material. The substantially rigid spherical member may also be operably configured to rotate 360 degrees within the ball housing and be operably configured to rotate any direction.

In accordance with another feature of the present invention, the push-up device is operably configured to move along a ground surface by rotating the substantially rigid spherical member against a ground surface, wherein the substantially rigid spherical member being a singular rotatable member. Additionally, the substantially rigid spherical member may be transversely retained by the ball housing of the base assembly and within the ball-housing cavity.

In accordance with a further feature, an embodiment of the present invention includes a device frame defining the elongated handle members and an annular center portion, wherein the annular center portion surrounding at least a portion of the ball housing of the base assembly.

In accordance with yet another feature, an embodiment of the present invention also includes the ball housing of the base assembly having a retention member disposed on the ball housing operable to receive and support the annular center portion of the device frame.

In accordance with an additional feature, an embodiment of the present invention also includes a strap, wherein the strap is disposed on the upper surface of the ball housing and coupled to the device frame.

In accordance with a further feature, an embodiment of the present invention includes the ball housing of the base assembly having at least one ball bearing coupled to the concave inner surface of the ball housing and disposed within the ball-housing cavity.

Also in accordance with the invention, a push-up device is disclosed that includes a device frame having a base assembly having an upper exterior surface area substantially all of a resilient and a flexible material and a ball housing with a concave inner surface spanning in a direction away from the upper exterior surface of the base assembly to a lower end, wherein the concave inner surface of the ball housing defines a ball-housing cavity and wherein the upper exterior surface is defined by a cushion coupled to an upper end of the ball housing. The device may also include two handle members removably coupled to the ball housing of the base assembly, each of the two handle members extending outwardly from respective sides of the ball housing in opposing directions in a co-linear configuration with one another to a terminal free distal end and have a proximal end and a handle member length separating the proximal end and the terminal free distal end. The handle members also have a user-gripping section disposed along the handle member length, wherein the user-gripping section spans at least approximately two inches in length and of a diameter at most approximately six inches. The device frame may also include an annular center portion surrounding at least a portion of the ball housing of the base assembly and include a retention member disposed on the ball housing operable to receive and support the annular center portion of the device frame. The device may also include a substantially rigid spherical member disposed partially within, and outside of, the ball-housing cavity and having a bottom ground-contact surface opposing the upper surface of the base assembly, wherein the substantially rigid spherical member is either a metallic or polymeric material and operably configured to rotate 360 degrees within the ball housing and be omni-directionally rotated. The device may also include a strap disposed on the upper surface of the ball housing and coupled to the device frame.

In accordance with another feature, an embodiment of the present invention include the base assembly also having at least one ball bearing coupled to the concave inner surface of the ball housing and disposed within the ball-housing cavity.

In accordance with the present invention, a method of using a push-up device by a user, the method comprising the steps of providing a push-up device having a base assembly having an upper surface and a ball housing with a concave inner surface spanning in a direction away from the upper surface of the base assembly to a lower end, the concave inner surface of the ball housing defining a ball-housing cavity and having two elongated handle members coupled to the ball housing of the base assembly, wherein each of the two elongated handle members extend outwardly from respective sides of the ball housing in opposing directions to a terminal free distal end. The device also includes a substantially rigid and singular spherical member disposed partially within, and outside of, the ball-housing cavity, wherein the substantially rigid and singular spherical member operably configured to rotate within the ball housing. The method also includes directly coupling each of the user's hands, respectively, to the two elongated handle members, positioning, with the push-up device at a first position along a push-up device translation path, the user's torso over the upper surface of the base assembly, and then propelling the push-up device, with the singular spherical member and a user impetus, from the first position along a push-up device translation path and along a ground surface to a second position along the push-up device translation path with the push-up device removed from underneath the user's torso.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DESCRIPTION OF INVENTION

Figure 1:
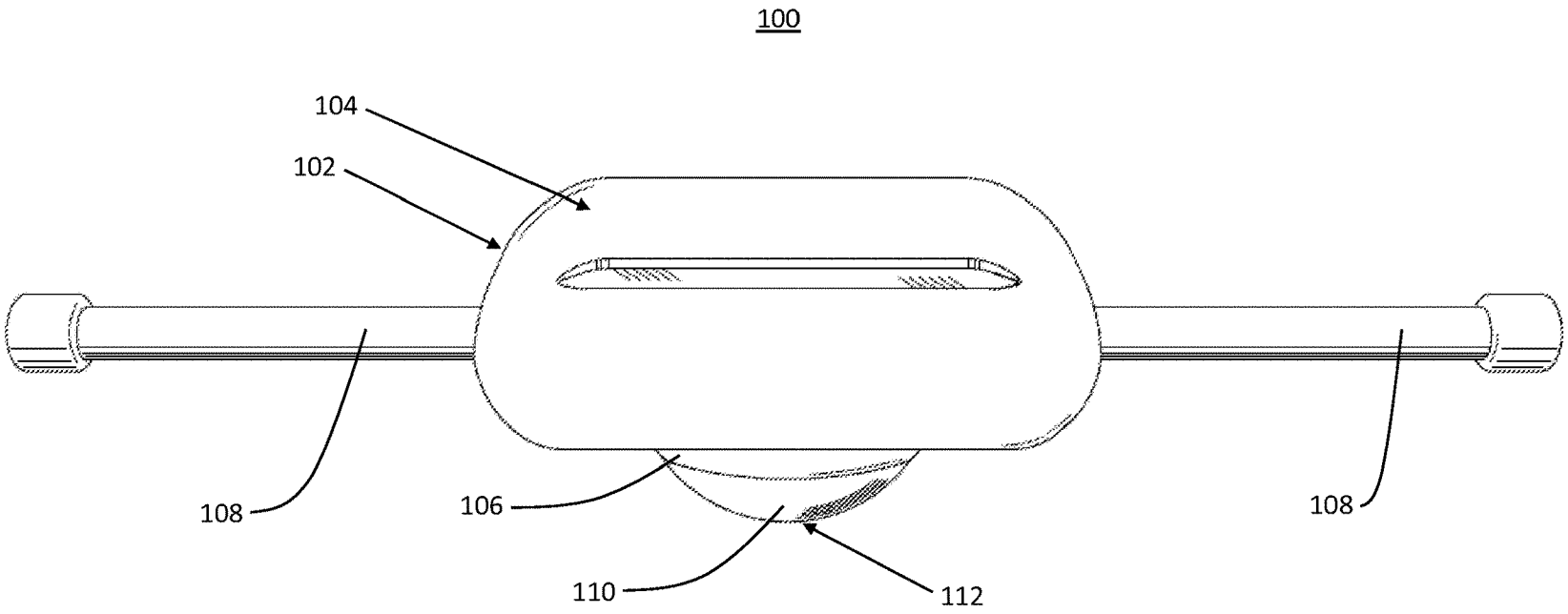
FIG. 1 depicts a perspective front view of a push-up device in accordance with one embodiment of the present invention.
Figure 2:
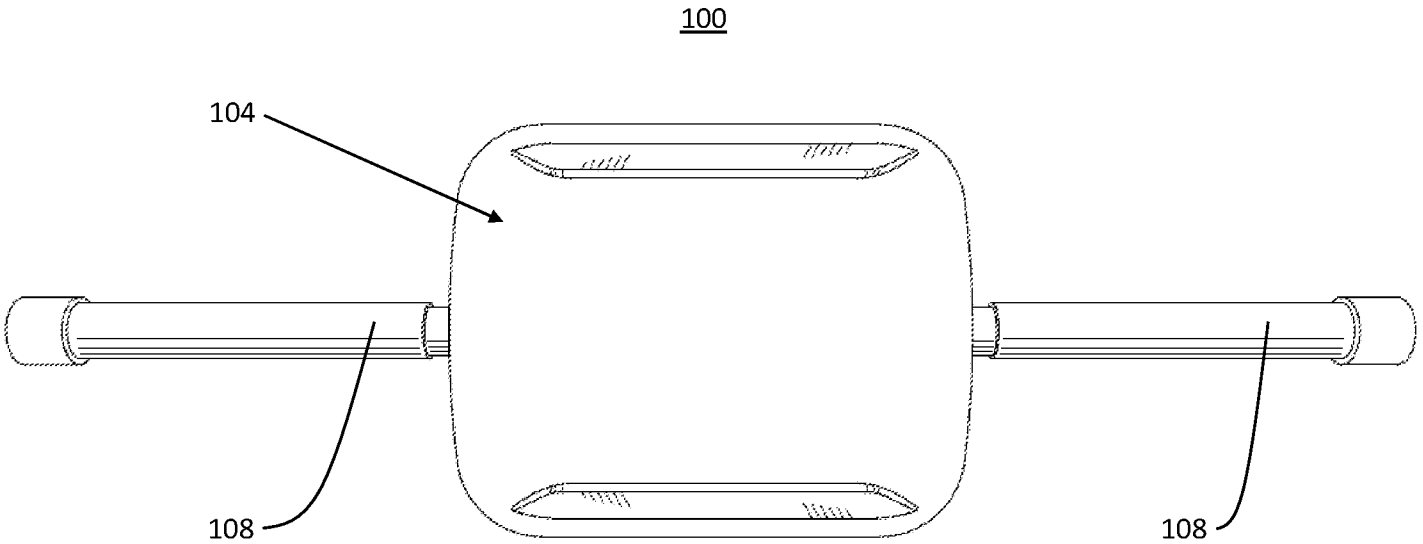
FIG. 2 is a top plan view of the push-up device of FIG. 1.
Figure 3:
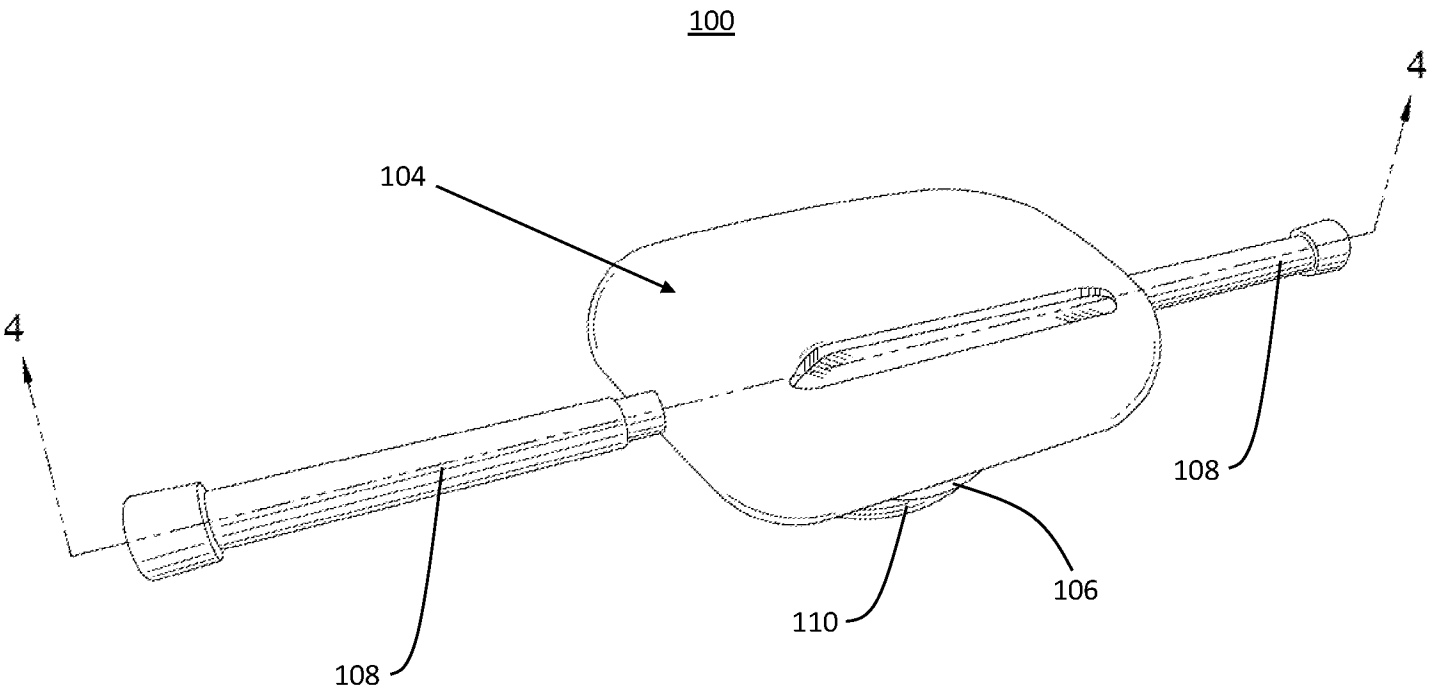
FIG. 3 is perspective view of the push-up device of FIG. 1.

It is believed that the invention will be better understood from a consideration of the following description in conjunction with the drawing figures, in which like reference numerals are carried forward. It is to be understood that the disclosed embodiments are merely exemplary of the invention, which can be embodied in various forms. Although the invention is illustrated and described herein as embodied in a push-up exercise device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the device spanning from the terminal free distal end of one elongated handle member to the terminal free distal end of the other elongated handle member.

Referring now to FIG. 1, one embodiment of the present invention is shown in a downward-looking perspective view. FIG. 1 shows several advantageous features of the present invention, but, as will be described below, the invention can be provided in several shapes, sizes, combinations of features and components, and varying numbers and functions of the components. The first example of a push-up device 100, as shown in FIG. 1, includes a base assembly 102, with an upper surface 104, flanked by two opposing handle members 108 that are operable to support (in whole or in part) a user utilizing the push-up device 100. The device 100 is described in the context of its principle application, i.e., carrying out a push-up-like exercise; however, as described below, the device 100 may be utilized to carry out other exercised and should not be interpreted as necessarily limited to carrying out a push-up.

In one embodiment, the base assembly 102 may include a ball housing 106 that may house a spherical member 110. The term "spherical" includes, but is not limited to, substantially spherical shapes, such as spheres and hemispheres that approximate half of a sphere (where applicable). The push-up device 100 provides the user with enhanced and varied muscle activation and stimulation. The push-up device 100 also permits the user to orient him or herself at an extreme tilt in a safe and effective manner while holding on to the handle members, which an orientation not practically or effectively accomplished with those known push-up devices. In one embodiment, the spherical member 110 may be operable to rotate within the ball housing 106 so as to permit the user to translate the device in multi-directional axes or angles on a ground surface, providing even further benefits to a user.

Base Assembly

Figure 4:
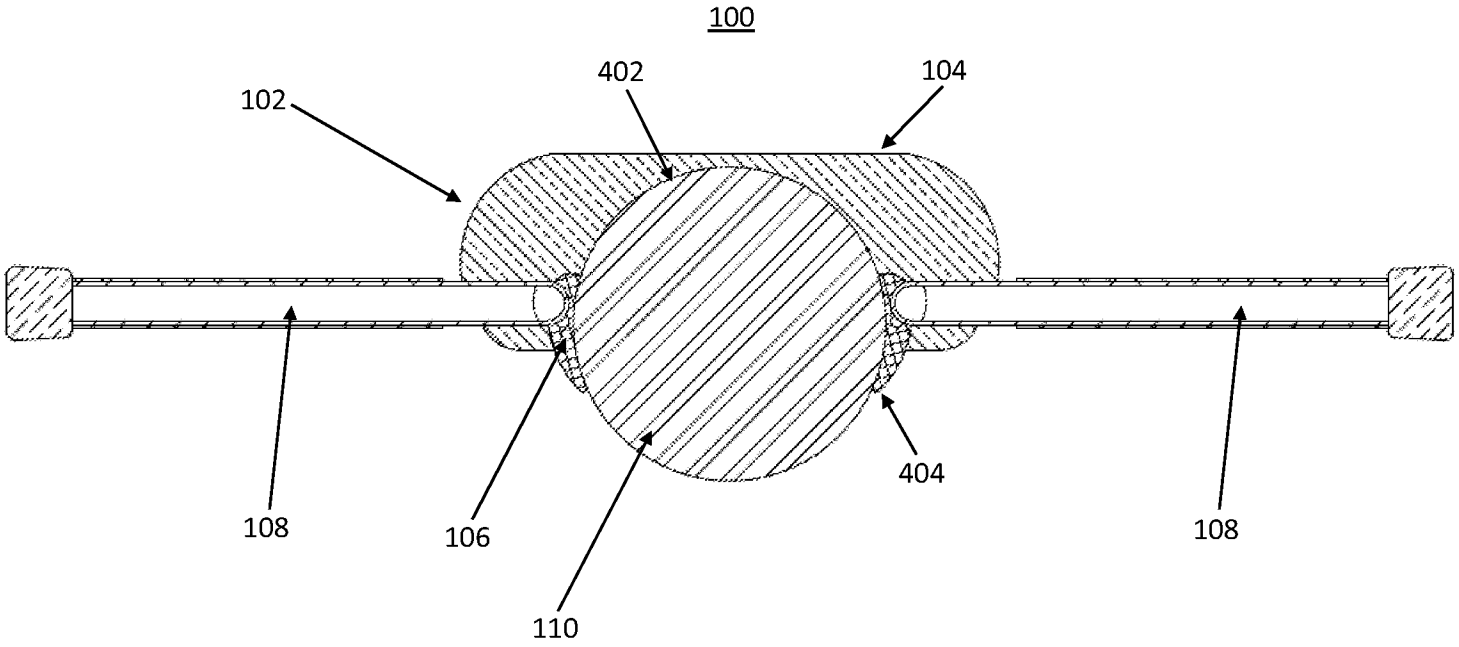
FIG. 4 is a cross-sectional view of the push-up device of FIG. 1 along section line 4-4 of FIG. 3.
Figure 5:
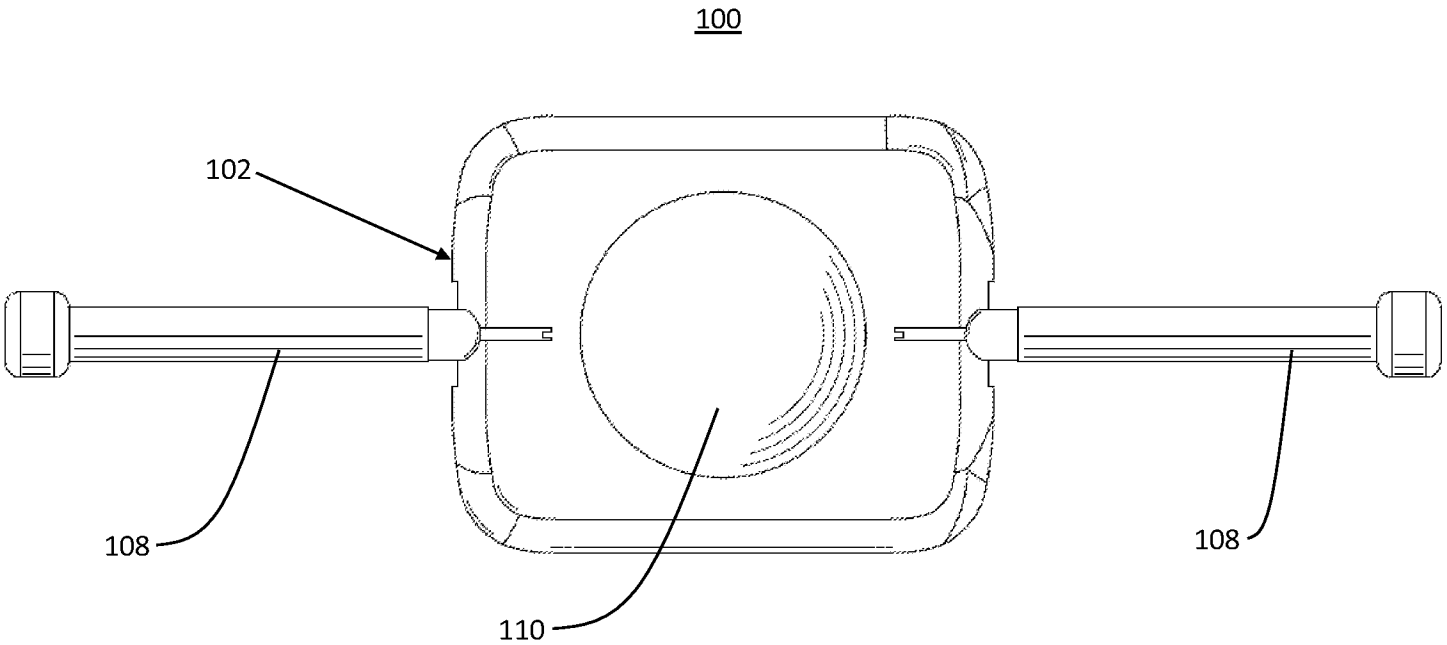
FIG. 5 is a bottom plan view of the push-up device of FIG. 1.
Figure 6:
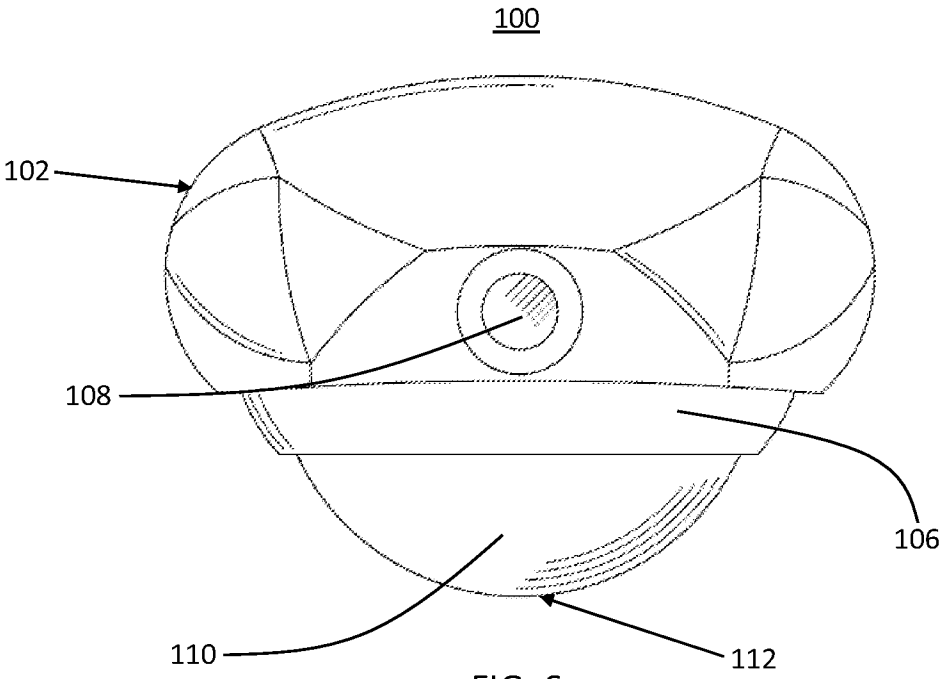
FIG. 6 is a side elevational view of the push-up device of FIG. 1.
Figure 12:
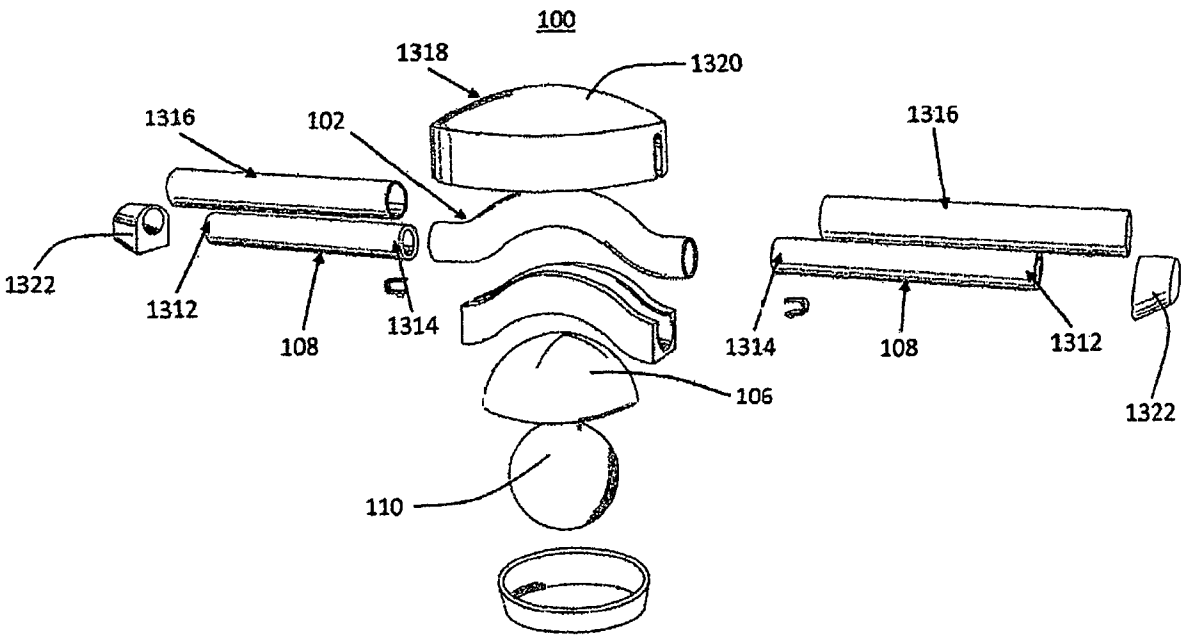
FIGS. 12-13 depict exploded views of a push-up device in accordance with one embodiment of the present invention.

The push-up device 100 may include a base assembly 102. In one embodiment, the base assembly 102 may have an upper surface 104 and a ball housing 106 with a concave inner surface 402 (FIG. 4) that spans in a direction away from the upper surface 104 to a lower end 404. In one embodiment, the concave inner surface 402 of the ball housing 106 may define a ball-housing cavity 1400 (best seen in FIG. 12). In one embodiment, the upper surface 104 may include an upper exterior surface area 1318 (FIG. 12) defined by the perimeter of the upper surface 104. In one embodiment, the upper exterior surface area 1318 may be substantially all of a resilient and a flexible or soft, yet resilient, material, such as EVA foam, or may be another material, such as a PVC layer that encapsulates EVA foam. In one embodiment, the base assembly 102 may include a cushion 1320 (FIG. 12) coupled to an upper end of the ball housing 106, and may define the upper exterior surface area 1318. In one embodiment, the cushion 1320 may be removable. In another embodiment, the cushion 1320 may be permanently attached to the base assembly 102.

Figure 13:
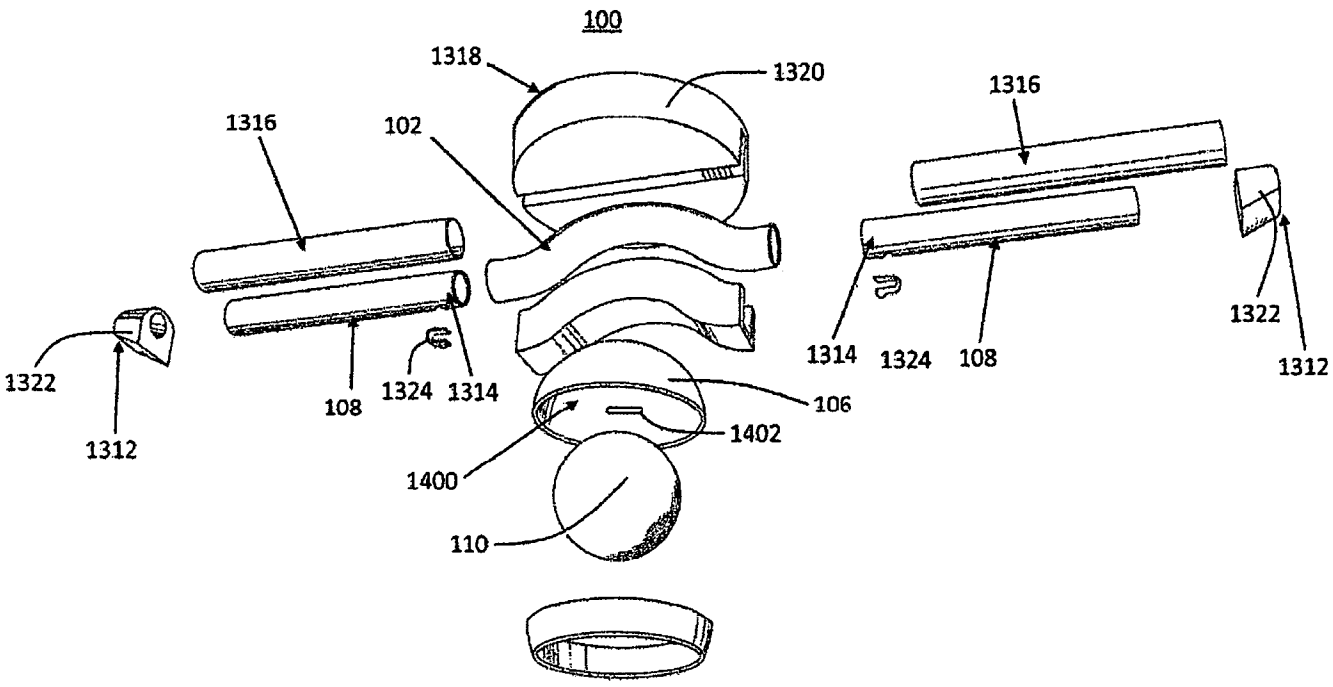

In one embodiment, the base assembly 102 may include at least one ball bearing (depicted in FIG. 13 as numeral 1402) coupled to the concave inner surface 402 of the ball housing 106 and disposed within the ball-housing cavity 1400. The ball bearing enables the spherical member 110 to effectively and efficiently rotate within the ball-housing cavity 1400. The concave inner surface 402 of the ball housing 106 may also be coated with a material having a low coefficient of friction, such as a ceramic-base coating or other coating Handle Members The push-up device 100 may include two handle members 108, which may consist of two separate and independent handles members 108 in one embodiment, or one unitary handle member 108 in other embodiments. The handle members 108 permit the user to grasp or hold onto them in order to use the push-up device 100. Said another way, the handle member 108 enables users to respectively grasp each end of the handle member 108 with their hands and move the device 100 by applying an impetus, e.g., through the user's weight, generated by the user. In one embodiment, the handle members 108 may be of a metallic tubing material or other rigid material sufficient to support at least 25 lbs. The handle members 108 may be of the same dimensions, or may be of different dimensions. In one embodiment, the handle members 108 may be elongated and may couple to a side of the ball housing 106 of the base assembly 102 using, for example, fasteners, such as clips 1324 that are designed to retain the handle members 108 to the base assembly 102. The clips 1324 may also be utilized to couple and stabilize various components of the base assembly 102. The handle members 108 may be cylindrical cantilever structures extending from the base assembly 102, or may be of a different shape and/or configuration with respect to the base assembly 102.

As used herein, the term "elongated" means having a thickness or diameter that is less than the total length spanning from the side of the ball housing 106. The handle members 108 may be greater than three inches spanning from the side of the ball housing 106 to effectuate a quick and effective handling or grasping of the handle 108 by the user. In one embodiment, the handle members 108 may be removable. In another embodiment, the handle members 108 may be fixed and nonremovable. In one embodiment, the handle members 108 may be telescopic (via a nodule-aperture configuration) to permit the user to store the handle members 108 within the base assembly 102.

In one embodiment, the handle members 108 may extend outwardly from respective sides of the ball housing 106 in substantially opposing directions. In one embodiment, the handle members 108 may be disposed in a co-linear configuration with one another. Said another way, the handle members 108 may be axially aligned with one another. In another embodiment, the handle members 108 may be disposed in a non-co-linear configuration with one another. In one embodiment, each handle member 108 may extend from the ball housing 106 to a terminal free distal end 1312 (best seen in FIG. 12). In one embodiment, each handle member 108 may include a proximal end 1314 (best seen in FIG. 12). In one embodiment, each handle member 108 may include a handle member length separating the proximal end 1314 and the terminal free distal end 1312.

The handle members 108 may include at least one user-gripping section 1316 (best seen in FIG. 12) that allows the user to grip the handle member 108 with comfort and ease. In one embodiment, the user-gripping section 1316 may surround the handle members 108 in whole. In another embodiment, the user-gripping section 1316 may surround the handle members 108 in part. In one embodiment, the user-gripping section 1316 may be on one, both, or neither handle member 108. In one embodiment, the user-gripping section 1316 may be cylindrical. In a preferred embodiment, each handle member length includes one user-gripping section 1316 that spans at least approximately two inches in length and is of a diameter of at most approximately six inches, providing the user with a comfortable surface to grip while using the push-up device 100. In one embodiment, one or both handle members 108 may include a cap or nodule 1322 at the terminal free distal end 1312 to prevent or inhibit a user's hands from slipping therefrom.

Spherical Member

In one embodiment, the push-up device 100 may include a spherical member 110 that allows the user to move the push-up device along a surface by rotating the spherical member 110. In one embodiment, the spherical member 110 may be substantially rigid, i.e., resist deformation with less than approximately 50 lbs of compression force subjected thereto. In another embodiment, the spherical member 110 may be elastically deformable. In one embodiment, the spherical member 110 may be made of a polymer-based material, such as plastic, or another material. In a preferred embodiment, the spherical member 110 is of a metallic material. The material and shape of the spherical member 110 allows the user to balance the push-up device 100 on the spherical member 110, using the spherical member 110 to move the push-up device 100 along a surface omnidirectionally. In a preferred embodiment, the spherical member 110 has a diameter of approximately four inches, although the diameter of the spherical member 110 may be greater or smaller, depending on the size of the push-up device and, specifically, the ball-housing cavity 1400.

In one embodiment, the spherical member 110 may be disposed partially within and partially outside of the ball-housing cavity 1400 of the base assembly 102. In one embodiment, the spherical member 110 may be transversely retained by the ball housing 106 of the base assembly 102 and within the ball-housing cavity 1400. In one embodiment, the spherical member 110 may couple with at least one exemplary ball bearing 1402 within the ball-housing cavity 1400, allowing the spherical member to rotate with ease within the ball-housing cavity 1400. In one embodiment, the spherical member 110 may be operable to be removed and used by the user when desired or to be exchanged with a spherical object of another dimension or another type of outer surface that has a greater or lower coefficient of friction, or another component having a curved surface. In another embodiment, the spherical member 110 may not be operable for removal. In one embodiment, the spherical member 110 may be fixedly attached within the ball-housing 106 of the base assembly 102.

In one embodiment, the spherical member 110 may be operably configured to rotate within the ball housing 106 of the base assembly 102. In a preferred embodiment, the spherical member 110 may be operably configured to rotate approximately 360 degrees within the ball housing 106 of the base assembly 102. In one embodiment, the spherical member 110 may be operably configured to be substantially omni-directionally rotated. In one embodiment, the spherical member 110 may be a singular rotatable member of the push-up device 100.

In one embodiment, the push-up device 100 may be operably configured to move along a ground surface by rotating the spherical member 110 against the ground surface. In one embodiment, the spherical member 110 may include a bottom ground-contact surface 112 that opposes the upper surface 104 of the base assembly 102. In one embodiment, the bottom ground-contact surface 112 may define a ground-contact plane.

Figure 14:
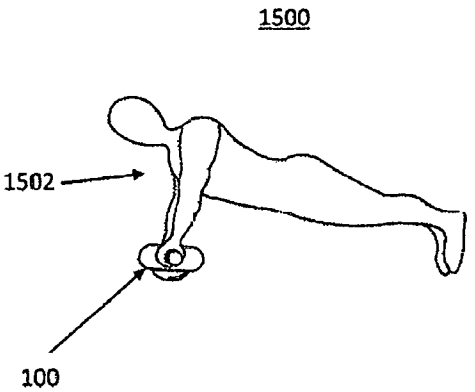
FIGS. 14-16 depict a method of using the push-up device of FIG. 1 to perform a push-up.

The push-up device 100 may include a base assembly 102. In one embodiment, the base assembly 102 may have an upper surface 104 and a ball housing 106 with a concave inner surface 402 (FIG. 4) that spans in a direction away from the upper surface 104 to a lower end 404. In one embodiment, the concave inner surface 402 of the ball housing 106 may define a ball-housing cavity 1006 (best seen in FIG. 10) and 1400 (best seen in FIG. 14). As seen best in FIGS. 10 and 13, the outer surface 1010 of the ball housing 106 may also be concave and be substantially parallel with the concave inner surface 402 of the ball housing 106. In one embodiment, the upper surface 104 may include an upper exterior surface area 1318 (FIG. 12) defined by the perimeter of the upper surface 104. In one embodiment, the upper exterior surface area 1318 may be substantially all of a resilient and a flexible or soft, yet resilient, material, such as EVA foam, or may be another material, such as a PVC layer that encapsulates EVA foam. In one embodiment, the base assembly 102 may include a cushion 1320 (FIG. 12) coupled to an upper end of the ball housing 106, and may define the upper exterior surface area 1318. In one embodiment, the cushion 1320 may be removable. In another embodiment, the cushion 1320 may be permanently attached to the base assembly 102.

In one embodiment, the bottom ground-contact surface 112 of the spherical member 110 may include all points disposed on it approximately equidistant to a fixed (and perhaps imaginary) point on the spherical member 110. In other embodiments, the bottom ground-contact surface 112 of the spherical member 110 may include all points disposed on it within approximately +/−25% range deviation from one another to a fixed (and perhaps imaginary) point on the spherical member 110. In preferred embodiments, the deviation will be no more than approximately +/−10%.

Device Frame

Figure 7:
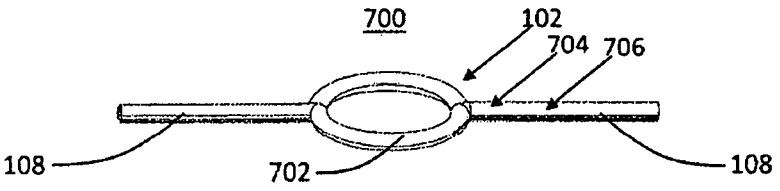
FIGS. 7-9 depict fragmentary views of the push-up device of FIG. 1.
Figure 8:
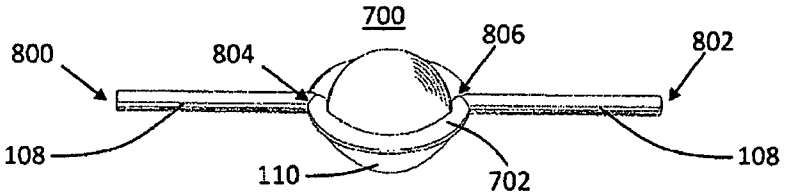
Figure 9:
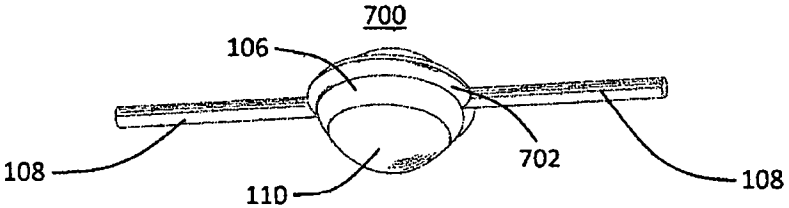
Figure 10:
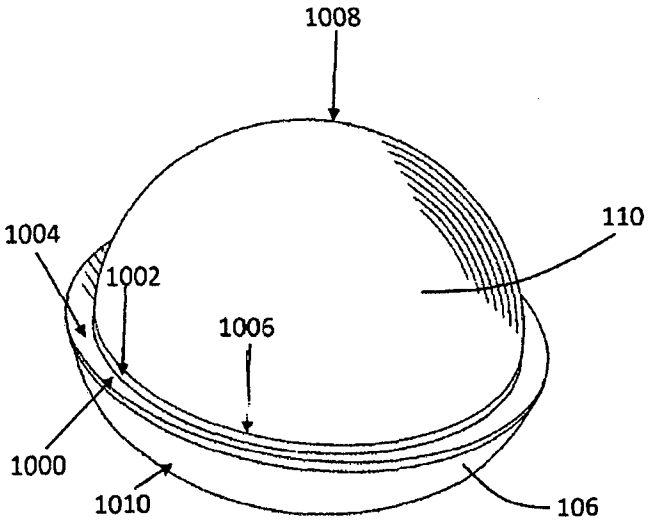
FIG. 10 depicts an upward-looking perspective view of a ball housing used with the push-up device in accordance with one embodiment of the present invention.

In one embodiment, the push-up device 100 may include a device frame 700 (depicted in FIG. 7) that includes an upper surface 704. In one embodiment, the device frame 700 may define the elongated handle members 108 with terminal free distal ends 800, 802, proximal ends 804, 806, and a user gripping section, e.g., section 706, and an annular center portion 702 (best seen in FIG. 7) as a single unit, i.e., it is unitary. In one embodiment, the annular center portion 702 may be disposed in the center of mass of the device or on or about the centroid of the push-up device 100. In one embodiment, the annular center portion 702 may surround and/or rest on at least a portion of the ball housing 106 of the base assembly 102. As seen best in FIG. 10, the ball housing 106 includes an inner concave surface 1002 and a lower end 1004. Additionally, as best seen in FIG. 10, those of skill in the art will appreciate from the disclosure herein that the spherical member 110 will have a bottom ground contact surface 1008 that is operable to generate a ground contact plane.

The device frame 700 forms part of the base assembly 102 of the push-up device 100. In one embodiment, the ball housing 106 of the base assembly 102 may include a retention member 1000 (best seen in FIG. 10) disposed on the ball housing 106 that is operable to receive and support at least a portion of the annular center portion 702 of the device frame 700. As used herein, the term "retention member" includes, but is not limited to, a flange, lip, or shelf, that is operable to receive and/or retain the annular center portion. In one embodiment, the retention member 1000 continuously or discontinuously surrounds the perimeter of the ball housing 106 and may be of a concave surface or recess that may be shaped and sized to receive a portion of the convex or tubular portion of the device frame 700. Said another way, the retention member 1000 may define a retention member recess that may frictionally retain and/or support a portion of the device frame 700. In other embodiments, fasteners may be used to facilitate in retaining the device frame 700 to the ball housing 106 and/or retention member recess.

Figure 11:
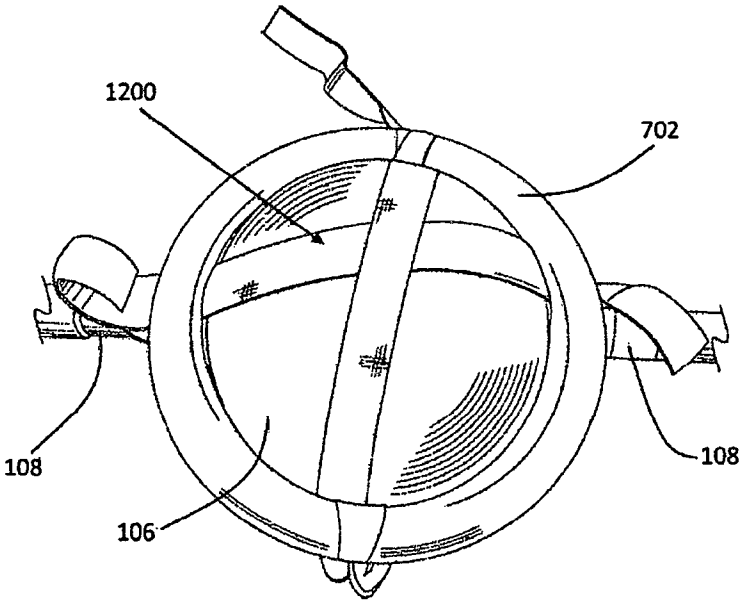
FIG. 11 depicts a downward-looking perspective view of a ball housing and device frame used with a push-up device in accordance with one embodiment of the present invention.

In one embodiment, a strap 1200 (as depicted in FIG. 11) may be disposed on the upper surface of the ball housing 106 and may be coupled to the device frame 700 by resting on the device frame 700 or attaching to the device frame 700. In another embodiment, the strap 1200 may be disposed on the upper surface of the ball housing 106 but not coupled to the device frame 700. The strap 1200 operates to keep the pressure exerted by a user on the push-up device 100 off of the base assembly 102, providing the push-up device 100 with additional structural security. In one embodiment, the strap 1200 may be of vinyl or other flexible material, allowing the strap 1200 to be moved with ease on the ball housing 106 or device frame 700.

Exemplary Methods of Use

Referring now to FIGS. 15-20, various methods of using the push-up device 100 of FIG. 1 to perform a traditional push-up, rolling push-up, or other exercises are provided. The method of using the push-up device 100 to perform a rolling push-up may begin at step 1800, where a user 1502 is positioned substantially parallel and non-co-planar with the push-up device 100 in a first position. The first position may also include the user's 1502 torso disposed over the upper surface 104 of the base assembly 102. The user 1502 may directly couple to at least one of the elongated handle members 108 of the push-up device 100 by gripping, holding, or grasping the elongated handle members 108. A portion of the user's 1502 body, such as the user's 1502 feet or knees, may contact a ground surface, allowing the user 1502 to balance the push-up device 100 against a ground surface on the spherical member 110, and tilt the push-up device 100, as well as the user's 1502 torso, at an angle with respect to the ground surface. During step 1800, the push-up device 100 may be in a first position along a push-up device 100 translation path.

The method of using the push-up device to perform a rolling push-up exercise 100 may proceed from step 1800 to step 1900, in which the user 1502 propels the push-up device 100, with the spherical member 110 and a user impetus, from the first position along a push-up device 100 translation path to a second position along a push-up device 100 translation path. The push-up device 100 may be propelled along a ground surface between the positions along the push-up device 100 translation path. The second position along a push-up device 100 translation path may be an extended position away from the user's 1502 torso. At the second position along a push-up device 100 translation path, the push-up device may be removed from underneath the user's 1502 torso.

The method of using the push-up device to perform a rolling push-up exercise 100 may proceed from step 1900 to step 2000, in which the push-up device 100 may be returned from the second position along the push-up device 100 translational path to the first position along the push-up device 100 translational path. At step 2000, the user's 1502 torso may also return from the second position to the first position. The user 1502 may repeat steps 1800-2000 to perform the rolling push-up exercise more than one time.

Figure 15:
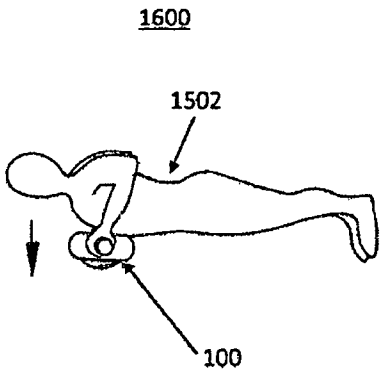
Figure 16:
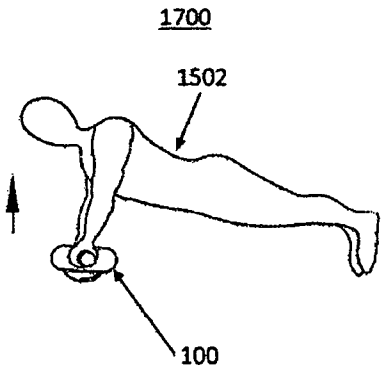
Figure 19:
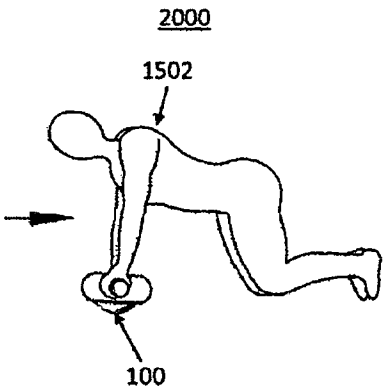
FIGS. 17-19 depict a method of using the push-up device of FIG. 1 to perform a rolling exercise
Figure 18:
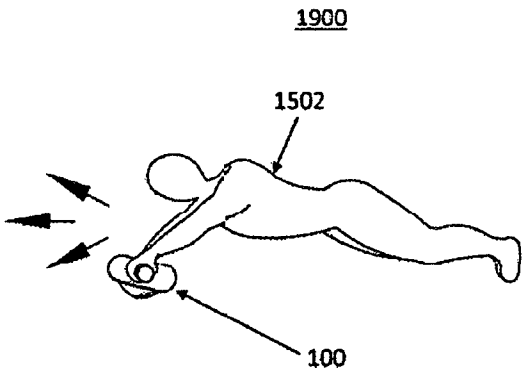
Figure 17:
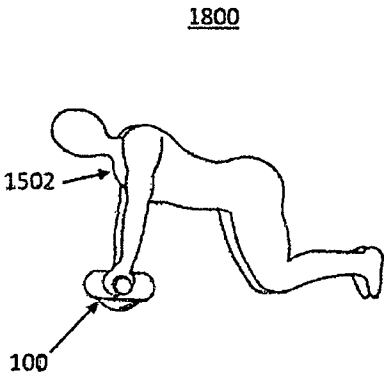

The user 1502 may generally use the method of performing a rolling push-up exercise to perform a traditional push-up, as depicted in FIGS. 15-17. The method of performing a traditional push-up is substantially similar to the method of performing a rolling push-up exercise, beginning at step 1500, wherein a user's 1502 torso is at a first position, elevated from the push-up device, and wherein the user 1502 grips the handle members 108 of the push-up device 100, balancing the push-up device 100 on the spherical member 110.

The method of performing a traditional push-up may proceed from step 1500 to step 1600, in which the user 1502 lowers his or her torso from a first position to a second position, the second position being closer to the push-up device 100 as compared with the first position. Said another way, the user's 1502 torso, in the second position, is closer to the push-up device 100 and to a ground surface.

The method of using the push-up device 100 may then proceed from step 1600 to step 1700, in which the user 1502 is raised from the second position to the first position, completing a traditional push-up. The push-up device 100 may remain in substantially the same position during this method of using the push-up device 100, and the push-up device 100 may balance on the spherical member 110 throughout the method of using the push-up device 100.

A push-up device 100 and method of use has been disclosed that employs the use of a spherical member 110 that makes contact with a ground surface and supports the weight of a user 1502 when the user 1502 grasps handle members 108 of the push-up device 100 and/or rests thereon. The user 1502 can balance on the push-up device 100, and can move the push-up device 100 along the ground surface by rotating the spherical member 110 of the push-up device 100, allowing the user 1502 to perform stimulating muscle exercises.

What is claimed is:

1. A push-up device comprising:

a base assembly having a device frame with an annular center portion, an upper surface, and a ball housing with a concave inner surface spanning in a direction away from the upper surface of the base assembly to a lower end and with a protruding retention member coupled to and surrounding a periphery of an outer surface of the ball housing that is sized and shaped to support a portion of the annular center portion of the device frame, the concave inner surface of the ball housing defining a ball-housing cavity and the annular center portion of the device frame surrounding a portion of the ball housing of the base assembly and supported by the protruding retention member of the ball housing;

two elongated handle members coupled to the ball housing of the base assembly, each of the two elongated handle members extending outwardly from respective sides of the ball housing in opposing directions to a terminal free distal end;

a substantially rigid spherical member disposed partially within, and outside of, the ball-housing cavity and having a bottom ground-contact surface opposing the upper surface of the base assembly, the substantially rigid spherical member operably configured to rotate within the ball housing; and a strap disposed on an upper surface of the ball housing and coupled to the annular center portion to facilitate in preventing movement of the ball housing in a direction upwardly and away from an upper surface of the annular ring.

2. The push-up device according to claim 1, wherein:

the substantially rigid spherical member is operably configured to rotate 360 degrees within the ball housing.

3. The push-up device according to claim 2, wherein:

the substantially rigid spherical member is operably configured to be omni-directionally rotated.

4. The push-up device according to claim 2, wherein:

the push-up device is operably configured to move along a ground surface by rotating the substantially rigid spherical member against a ground surface, the substantially rigid spherical member being a singular rotatable member.

5. The push-up device according to claim 1, further comprising:

a ground-contact plane defined by the bottom ground-contact surface of the substantially rigid spherical member, the ground-contact plane parallel and non-coplanar with the orientation of the two elongated handle members.

6. The push-up device according to claim 5, wherein:

the two elongated handle members are disposed in a co-linear configuration with one another.

7. The push-up device according to claim 1, wherein the two elongated handle members each further comprise:

a proximal end and a handle member length separating the proximal end and the terminal free distal end; and a user-gripping section disposed along the handle member length, the user-gripping section spanning at least two inches in length and at most the handle member length and of a diameter greater than zero and at most six inches.

8. The push-up device according to claim 1, wherein:

the substantially rigid spherical member is at least one of a metallic and a polymeric material.

9. The push-up device according to claim 1, wherein:

the substantially rigid spherical member is transversely retained by the ball housing of the base assembly and within the ball-housing cavity.

10. A push-up device comprising:

a device frame having:

an upper exterior surface area and an annular center portion with a plurality of straps coupled thereto in a crisscross configuration and defining a concave ball housing with a concave inner surface spanning in a direction away from the upper exterior surface of the base assembly to a lower end, the concave inner surface of the ball housing defining a ball-housing cavity, the plurality of straps facilitating in preventing movement of the ball housing in a direction upwardly and away from an upper surface of the annular center portion; and two handle members coupled to the annular center portion of the device frame, each of the two handle members extending outwardly from respective sides of the annular center portion in opposing directions in a co-linear configuration with one another to a terminal free distal end and having:

a proximal end and a handle member length separating the proximal end and the terminal free distal end; and a user-gripping section disposed along the handle member length, the user-gripping section spanning at least two inches in length and at most the handle member length and of a diameter greater than zero and at most six inches; and a substantially rigid spherical member disposed partially within, and outside of, the ball-housing cavity and having a bottom ground-contact surface opposing the upper exterior surface area of the device frame, the substantially rigid spherical member of at least one of a metallic or polymeric material and operably configured to rotate 360 degrees within the ball housing and be omni-directionally rotated.

11. The push-up device of claim 10, further comprising:

a ground-contact plane defined by the bottom ground-contact surface of the substantially rigid spherical member, the ground-contact plane parallel and non-coplanar with the orientation of the two handle members, the push-up device is operably configured to move along a ground surface by rotating the substantially rigid spherical member against a ground surface, the substantially rigid spherical member being a singular rotatable member.

12. The push-up device of claim 10, wherein:

the substantially rigid spherical member is transversely retained by the ball housing of the base assembly and within the ball-housing cavity.

13. A push-up device comprising:

a base assembly having:

an upper surface;

a ball housing with a concave outer surface and inner surface both spanning in a direction away from the upper surface of the base assembly to a lower end, the concave inner surface of the ball housing defining a ball-housing cavity; and a device frame with an annular center portion having a strap coupled thereto to prevent movement of the ball housing in a direction upwardly and away from an upper surface of the annular center portion;

two elongated handle members each respectively coupled to opposing ends of the device frame and extending outwardly from respective sides of the ball housing in opposing directions to a terminal free distal end; and a substantially rigid spherical member disposed partially within, and outside of, the ball-housing cavity and having a bottom ground-contact surface opposing the upper surface of the base assembly, the substantially rigid spherical member operably configured to rotate within the ball housing.

* * * * *